United States Patent [19]

Bartlett

[11] Patent Number: 4,992,020

[45] Date of Patent: Feb. 12, 1991

[54] FRONT LOADER LIFTING ATTACHMENT

[76] Inventor: Charles Bartlett, 2713 Phil La., Marrero, La. 70072

[21] Appl. No.: 481,516

[22] Filed: Mar. 13, 1990

[51] Int. Cl.[5] ..... B66C 1/00

[52] U.S. Cl. ..... 414/723; 37/120

[58] Field of Search ..... 414/722, 723, 785, 912, 414/920; 37/118 R, 120, DIG. 3

[56] References Cited

U.S. PATENT DOCUMENTS

| | | | |
|---|---|---|---|
| 3,034,237 | 5/1962 | Wolfe et al. | 37/120 X |
| 3,039,210 | 6/1962 | Slaughter | 37/118 R X |
| 3,056,219 | 10/1962 | Jeffrey | 414/722 X |
| 4,537,549 | 8/1985 | Knels | 414/722 X |

*Primary Examiner*—Robert J. Spar
*Assistant Examiner*—Donald W. Underwood
*Attorney, Agent, or Firm*—Keaty & Keaty

[57] ABSTRACT

A lifting attachment for securing to lifting arms of a front end loader has a pair of attachment brackets pivotally connected to the lifting arms, A vertical I-shaped solid plate rear wall carries the attachment brackets in a fixed relationship thereto. A top solid plate is angularly attached to the vertical rear wall, inclining downwardly and extending forward from the rear wall. A plurality of supporting plates support the top plate from the bottom, forming a "wedge-shaped" lifting element which has no side walls extending upwardly from the top plate, thus forming no restrictions to the lateral size of loads which can be handled by the lifting attachment.

12 Claims, 2 Drawing Sheets

FRONT LOADER LIFTING ATTACHMENT

BACKGROUND OF THE INVENTION

The present invention relates to a load lifting attachment for use with a front end loader or tractor which is designed to handle various type of materials, such as loose materials, oversized singular bulky loads, for example broken pieces of concrete, asphalt, trees and the like.

Different attachments for front loaders are known to have been used for handling of loose granular materials, smaller size singular pieces, such attachments usually comprising a bucket- or scoop-type implements which are provided with a bottom and end walls defining the lateral dimensions of the implement.

However, it has been found that the end walls cause a certain inconvenience in handling large objects, such as trees, since the lateral dimensions of the bucket are limited by the confines of the end walls of the bucket.

To solve this problem a number of various solutions have been suggested, one of the most common solutions being the use of a fork lift adapter which is attached to the leading edge of the bucket at laterally spaced locations and extends forward from the leading edge during use. The tines of the fork may be two or more in number. Some of the adapters provide for the tines to be folded, pivoting about the point of their attachment to the bucket.

Such adapters cannot handle loose material and need to be disengaged from the bucket when such type of materials must be handled. Attachment of the adapters back to the bucket requires time, which adversely affects the cost of the use of equipment.

The present invention contemplates elimination of the drawbacks of the know solutions and provision of a more universal attachment for front end loaders which does not require any extensive modification of the front loader itself.

SUMMARY OF THE INVENTION

The present invention overcomes drawbacks of the prior art and solves its problems in a simple and straightforward manner.

The lifting attachment is provided for use with a front loader which has power operated lifting arms. The lifting attachment has a pair of brackets which are pivotally attached to the lifting arms about their upper and lower portions. The brackets are carried by a rear side of a vertically extending rear wall of the attachment, the rear wall having a general I-shape.

One or more reinforcing plates are rigidly attached to the rear side of the rear wall between the top and the bottom ends of the rear wall. A solid rectangular plate is angularly fixedly attached to the front side of the rear wall, extending downwardly and forwardly from the rear wall.

A supporting plate means are fixedly attached to a bottom surface of the top plate and the rear wall, supporting and ensuring angular orientation of the top plate in relation to the rear wall.

Some of the support plate means extend in perpendicular relationship to a longitudinal axis of the rear wall towards a leading edge of the attachment. A transverse support plate, which is fixedly attached to the top plate in parallel relationship to the top plate forms a leading edge of the attachment.

A plurality of bottom channels are formed by triangular side walls which extend between the bottom surface of the top plate and the bottom surfaces of the support plates which are oriented in perpendicular relationship to the rear wall.

There are no end walls which would extend upwardly from the top plate, thus the lateral dimensions of the attachment are limited only by the side edges of the top plate.

It is therefore an object of the present invention to provide a lifting attachment for a front loader which is capable of handling oversized loads.

It is a further object of the present invention to provide a lifting attachment which is easy to manufacture and attach to a front loader.

It is still another object of the present invention to provide a lifting attachment which has strong structural elements capable of handling heavy loads, when required.

It is still a further object of the present invention to provide a lifting attachment which can be used for handling various type loads, both loose material and singular pieces.

These and other objects of the present invention will be more apparent to those skilled in the art from the following detail description of the invention.

BRIEF DESCRIPTION OF THE DRAWINGS

Reference will now be made to the drawings, wherein like parts are designated by like numerals, and wherein.

DESCRIPTION OF THE PREFERRED EMBODIMENT

Figure 1:
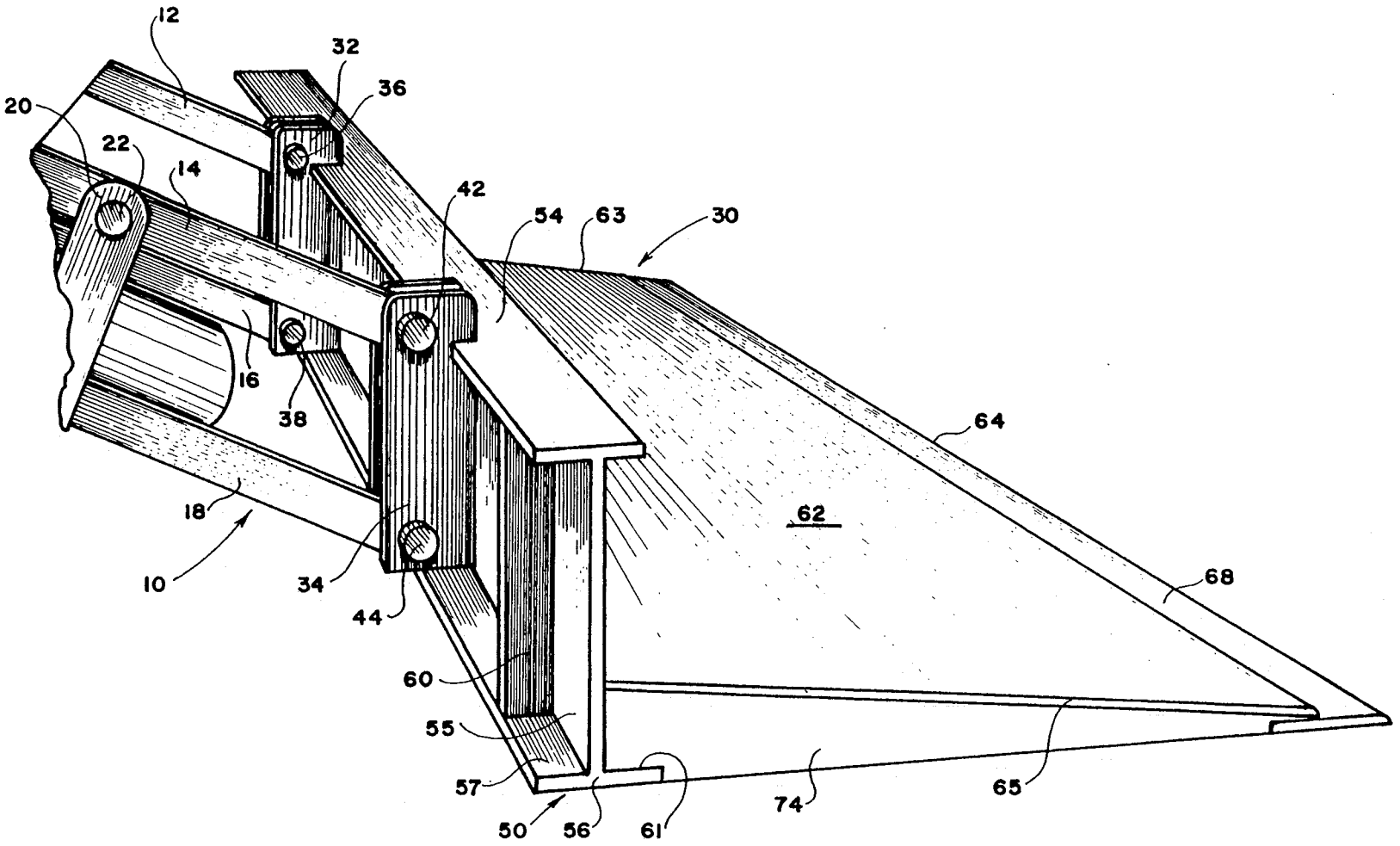
FIG. 1 is a perspective view of the lifting attachment in accordance with the present invention mounted on a front loader.

Referring now to the drawings and in particular to FIG. 1, there is shown a forward end of a front loading tractor 10 which is provided with hydraulically operated upper lift arms 12 and 14 and lower lift arms 16 and 18 secured together in a spaced-apart vertical relationship by a pair of cross pieces 20 (only one is seen is FIG. 1) and adapted for pivotal movement about pivot pin 22.

The lift arms 12, 14, 16 and 18 allow lifting and tilting of the lifting attachment 30, which is shown secured to the lifting arms by a pair of laterally spaced brackets 32 and 34. The bracket 32 is formed by two parallel plates 33, 35 which have aligned openings adapted to receive an upper pivot pin 36 and lower pivot pin 38, respectively, therethrough.

Corresponding co-aligned openings are made in the ends of the lift arms 12, 14, 16 and 18 opposite the ends which are secured to the cross pieces 20. By engaging the pivot pin 36 through the opening in the upper portion of the plate 33, coaligned openings in lift arm 12 and upper portion of the plate 35, the upper part of the bracket 32 is pivotally secured to the lift arm 12 in such a manner that the lift arm is "sandwiched" between the plates 33 and 35.

In a similar manner, the lower pivot pin 38 secures together the lift arm 16 with the lower portions of the plates 33 and 35.

Likewise, the lift arm 14 is pivotally secured by the pivot pin 42 to the upper portions of plates 37 and 39, while the lower pivot pin 44 secures in pivotal relationship the lower portion of plates 37 and 39.

By controlling the movement of the lift arms 12, 14, 16 and 18 an operator transmits the lifting and tilting force to the brackets 32 and 34 trough the pivotal attachment of the brackets 32 and 34 to the lift arms. The brackets 32 and 34 extend in transverse relationship to the lift arm similar to the cross pieces 20.

Figure 2:
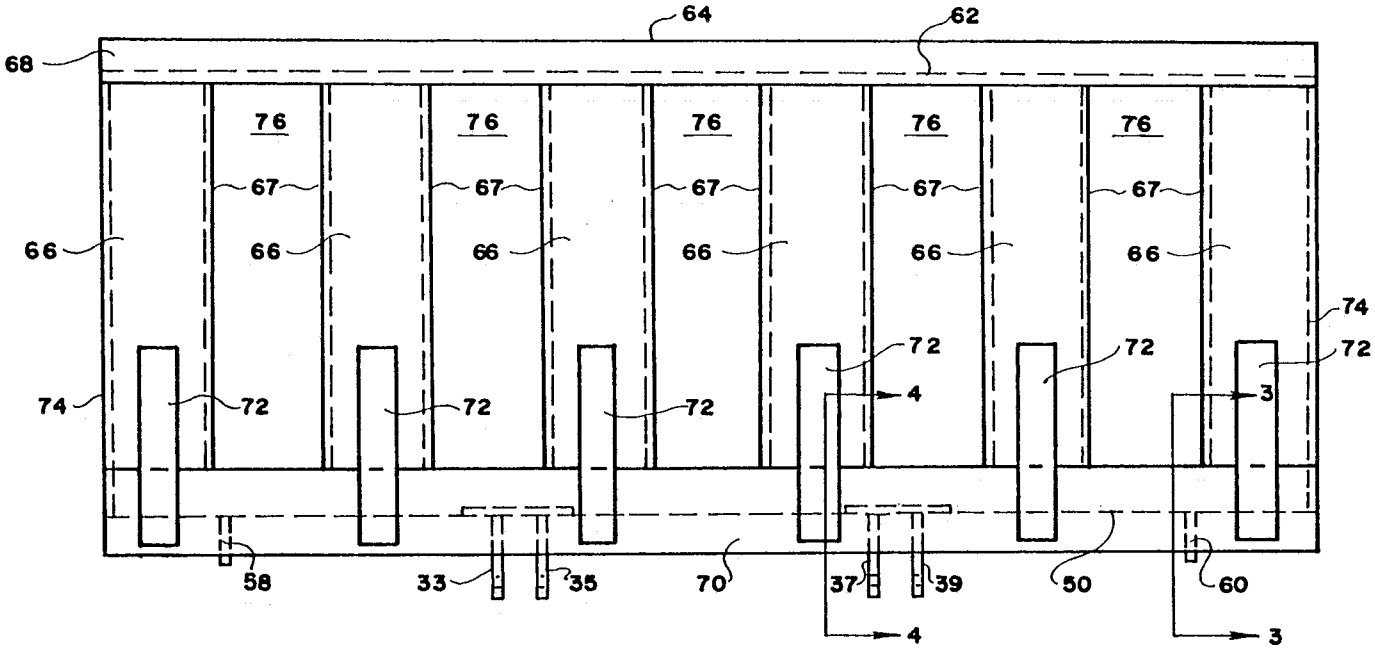
FIG. 2 is a bottom plan view of the attachment in accordance with the present invention.
Figure 5:
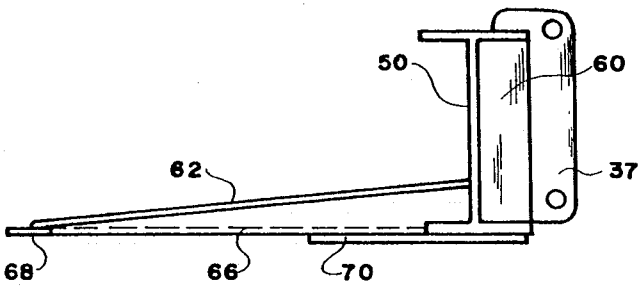
FIG. 5 is a side plan view of the attachment in accordance with the present invention.
Figure 4:
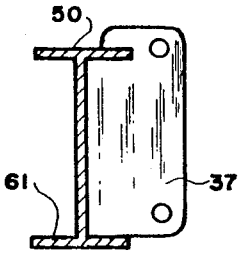
FIG. 4 is a cross sectional view taken along lines 4—4 of FIG. 2.
Figure 3:
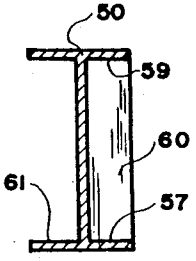
FIG. 3 is a cross sectional view taken along lines 3—3 of FIG. 2.

As shown in FIGS. 1 and 2, the lifting attachment 30 further comprises a vertically extending solid rear wall 50 which is formed by an I-shaped elongated plate having a vertical part 52 and an upper transverse piece 54 and a lower transverse piece 56, both rigidly integrally attached to the vertical part 52.

The vertical part 52 has a front surface 53 and a rear surface 55. The plates 33, 35, 37 and 39 are rigidly attached, such as by welding to the lower transverse piece 56, rear surface 55 of the rear wall 50 and to the upper transverse piece 54, extending to a distance above the uppermost limits of the transverse piece 54, such as not to interfere with the pivotal movement of the upper portions of the brackets 32 and 34. As can be seen in the drawings, the brackets 32 and 34 extend substantially perpendicularly to the transverse pieces 54 and 56, while their longitudinal axes are in substantially parallel relationship to the rear wall 50.

A pair of reinforcing plate means 58 and 60 (only plate 60 can be seen in FIG. 1) are rigidly attached, such as by welding, to the rear wall 50, with the bottom edges of the plates 58 and 60 resting on the surface 57 of the lower transverse piece 56, while the top edges of the plates 58 and 60 engage the downwardly facing surface 59 of the upper transverse piece 54. The surfaces 57 and 59 are formed by sections of the transverse pieces 54 and 56 which extend outwardly from the rear surface 55 of the wall 50. The reinforcing plate means can be one or more in number.

The plates 58 and 60 extend, therefore, in substantially perpendicular relationship to the transverse pieces 54 and 56, while their longitudinal axes extend in substantially parallel relationship to the rear wall 50 and the brackets 32 and 34.

Rigidly attached by welding to the front surface 53 of the wall 50 is a solid rectangular top plate 62 which has lateral dimensions substantially equal to the longitudinal dimensions of the rear wall 50. The plate 62 is attached to the wall 50 a distance from the lower transverse piece 56 and extends at an angle to the wall 50 gradually inclining downwardly till it intercepts an imaginary plane formed by the bottom surface of the lower transverse piece 56.

The free forward edge of the plate 62 approximates a leading edge 64 of the lifting attachment 30.

A plurality of cross supporting plates 66 are rigidly secured by welding to the section 61 of the lower transverse piece 56, extending perpendicularly to the elongated section 61 of the transverse piece 56 and to the rear wall 50. The length of the supporting plates 66 is slightly less or equal to the transverse length of the edges 63 and 65 of the plate 62. The supporting plates 66 are equidistantly mounted in parallel relationship to each other along the bottom of the attachment 30.

Extending along the bottom of the edge 64 of the plate 62 is a front longitudinal support plate 68 which is welded to the front edge 64 of the plate 62 and to the supporting plates 66, thus rigidly fixing the plates 66 to the front end of the plate 62. The foremost edge of the plate 68 forms a leading edge 64 of the attachment 30.

Rigidly attached to the bottom of the transverse piece 56 and extending along the length thereof is a rear longitudinal support plate 70 which overlaps the rear ends of the supporting plates 66 and assists in retaining them together in a spaced-apart parallel relationship.

The attachment 30 is further reinforced by a plurality of bottom securing strips 72, which partially overlap the rear longitudinal support plate 70 and the cross supporting plates 66, extending in parallel relationship to the supporting plates 66, extending in parallel relationship to the support plate 70. The strips 72 equal in number the plates 66 and are attached by welding to both the plates 66 and the plate 70.

A pair of triangular end walls 74 (only one end wall 74 can be seen in FIG. 1) close the space between the top plate 62 and outermost supporting plates 66. The end walls 74 provide further structural integrity to the attachment 30 and assist in retaining the top plate 62 in its angular relationship to the rear wall 50.

The spaces between outer limits of adjoining supporting plates 66 form bottom channels 76, the channels 76 gradually decreasing in depth from the rear portions adjacent the rear wall 50 towards the front portions adjacent the leading edge 64.

Each supporting plate 66 further comprises side walls 67 which extend vertically from the plates 66 towards the point of connection with the top plate 66. Thus, each channel 76 is formed by a pair of parallel triangular side walls 67 and a bottom surface of the top plate 62. The side walls 67 are rigidly attached by welding to both the reinforcing plates 66 and the bottom of the top plate 62.

As will be appreciated, the side walls 67, similar to the end walls 74, are triangular in longitudinal section and assist in retaining the top plate 62 in its angular relationship towards the end wall 50, while further reinforcing the structure of the lifting attachment 30.

In operation, the attachment 30 is controlled by handling of the lift arms from a control panel of a tractor to which the attachment 30 is secured. The leading edge 64 of the attachment 30 is lowered to a level from which the material needs to be picked up and manipulated in such a manner, as to ensure positioning of the material on the top plate 62, after which the attachment is further manipulated to transport the material and deposit it to a desired location.

As was mentioned above, the lack of end walls which extend above the top plate 62 allows to use the wedge-shaped attachment 30 for handling of oversized singular loads, such as trees, pieces of broken concrete, sections of planted grass and the like. The lateral dimensions of the handled pieces no longer poses a problem, since the only support is provided by a flat top plate 62.

The attachment 30 can be also successfully used for handling of loose granular material, such as sand, gravel, etc., which tends to form a pyramidal shape when picked up by the top plate 62 and remain on the top plate 62 until transported to a desired location.

While only one preferred embodiment of this invention was described by way of illustration herein, it will be obvious to those skilled in the art that many changes and modification can be made without departing from the spirit of the invention. We, therefore, pray that our rights to the present invention be limited only by the scope of the appended claims.

We claim:

1. A lifting attachment for a front loader having power operation lifting arms, the attachment comprising:

an attachment bracket means pivotally connected to the lifting arms;

an elongated I-shaped rear wall rigidly attached at its rear side to the bracket means in substantially perpendicular relationship thereto;

a downwardly inclined solid top plate means fixedly attached at an angle to a front side of the rear wall at a vertical distance from a bottom end of the rear wall and extending forwardly from the rear wall, a front edge of the top plate being proximate a leading edge of the attachment;

a supporting plate means rigidly attached to a bottom end of the rear wall and extending towards the leading edge of the attachment in co-planar relationship to a plane defined by the bottom end of the rear wall for supporting the top plate; and a pair of parallel end walls fixedly secured between opposite lateral ends of the top plate and the supporting plate means for retaining the top plate in an angular relationship to the rear wall.

2. The lifting attachment of claim 1, wherein said top plate has a generally rectangular configuration and wherein lateral dimensions of the top plate are substantially equal to longitudinal dimensions of the rear wall.

3. The lifting attachment of claim wherein said supporting plate means comprise a plurality of spaced-apart parallel supporting plates fixedly attached at their rear edges to the bottom end of the rear wall and extending in substantially perpendicular relationship from the rear wall towards the leading edge of the attachment, a front longitudinal support plate transversing front edges of the parallel supporting plates and fixedly secured to the front edges and the top plate forming a leading edge in substantially parallel relationship to a front edge of the top plate, and a rear longitudinal support plate overlapping the rear edges of the parallel supporting plates and fixedly secured to the rear edges, while extending in substantially parallel relationship to the rear wall.

4. The lifting attachment of claim 1, further comprising reinforcing means mounted on the rear wall in substantially parallel relationship to the bracket means.

5. The lifting attachment of claim 4, wherein said reinforcing means comprises at least one reinforcing plate fixedly attached to the rear side of the rear wall and extending between a bottom end and an upper end of the rear wall.

6. The lifting attachment of claim 5, wherein said bracket means is pivotally connected to the lift arms at its lower and its upper portions.

7. The lifting attachment of claim 6, wherein an upper pivotal point of the bracket means is positioned above the upper end of the rear wall.

8. The lifting attachment of claim 3, wherein a plurality of bottom channels are formed between the parallel reinforcing plates, the channels gradually decreasing in depth from rear portions to front portions thereof.

9. The lifting attachment of claim 8, further comprising side walls fixedly attached on opposite sides of each supporting plate, said side walls being generally triangular in longitudinal section, said side walls and a bottom surface of the top plate defining the bottom channels.

10. A lifting attachment for a front loader having power operated lifting arms, the attachment comprising:

an attachment bracket means pivotally connected to the lifting arms at its lower and upper portions;

an elongated I-shaped rear wall rigidly attached at its rear side to the bracket means in substantially perpendicular relationship thereto, said rear wall having a top end, a bottom end, a front side and a rear side;

a downwardly inclined solid plate fixedly attached at an angle to the front side of the rear wall at a vertical distance from the bottom end of the rear wall and extending forwardly from the rear wall, a front edge of the top plate being proximate a leading edge of the attachment;

a supporting plate means rigidly attached to the bottom end of the rear wall and extending towards the leading edges of the attachment in co-planar relationship to a plane defined by the bottom end of the rear wall for supporting the top plate, said supporting plate means comprising a plurality of spaced-apart parallel supporting plates fixedly attached at their rear edges to the bottom end of the rear wall and extending in substantially perpendicular relationship from the rear wall towards the leading edge of the attachment, a front longitudinal support plate transversing front edges of the parallel supporting plates and fixedly secured to the front edges and the front end of the top plate forming the leading edge of the attachment, and a rear longitudinal support plate overlapping the rear edges of the parallel supporting plate and fixedly secured to the rear edges, while extending in substantially parallel relationship to the rear wall;

a plurality of side walls fixedly attached to opposite sides of each supporting parallel plate, said side walls being generally triangular in longitudinal section, said side walls and a bottom surface of the top plate defining a plurality of bottom channels; and a reinforcing means mounted on the rear side of the rear wall in substantially parallel relationship to said bracket means, said reinforcing plates fixedly attached to the rear wall and extending between the bottom end and the upper end of the rear wall.

11. The lifting attachment of claim 10, wherein an upper pivotal point of the bracket means is positioned above the upper end of the rear wall.

12. The lifting attachment of claim 10, wherein said top plate has a generally rectangular configuration and wherein lateral dimensions of the top plate are substantially equal to longitudinal dimensions of the rear wall.

* * * * *